US010844313B2

(12) United States Patent
Kimoto et al.

(10) Patent No.: US 10,844,313 B2
(45) Date of Patent: Nov. 24, 2020

(54) WATER LUBRICANT COMPOSITION AND WATER LUBRICATING SYSTEM

(71) Applicants: DAICEL CORPORATION, Osaka (JP); TOHOKU UNIVERSITY, Sendai (JP)

(72) Inventors: Norihiro Kimoto, Himeji (JP); Hisayoshi Ito, Himeji (JP); Ming Liu, Himeji (JP); Koshi Adachi, Sendai (JP); Hirotsuna Sato, Sendai (JP)

(73) Assignees: DAICEL CORPORATION, Osaka (JP); TOHOKU UNIVERSITY, Sendai (JP)

( * ) Notice: Subject to any disclaimer, the term of this patent is extended or adjusted under 35 U.S.C. 154(b) by 111 days.

(21) Appl. No.: 16/301,932

(22) PCT Filed: Feb. 21, 2017

(86) PCT No.: PCT/JP2017/006331
§ 371 (c)(1),
(2) Date: Nov. 15, 2018

(87) PCT Pub. No.: WO2017/199503
PCT Pub. Date: Nov. 23, 2017

(65) Prior Publication Data

US 2019/0218475 A1 Jul. 18, 2019

(30) Foreign Application Priority Data

May 16, 2016 (JP) ..... 2016-097849

(51) Int. Cl.
*C10M 173/02* (2006.01)
*C10M 103/02* (2006.01)
(Continued)

(52) U.S. Cl.
CPC ..... *C10M 173/02* (2013.01); *C10M 103/02* (2013.01); *C10M 2201/02* (2013.01);
(Continued)

(58) Field of Classification Search
CPC ..... C10M 2201/02; C10M 2201/041; C10N 2250/12; C10N 2220/082; C10N 2230/06; C10N 2020/095; C10N 2030/06
See application file for complete search history.

(56) References Cited

U.S. PATENT DOCUMENTS 5,861,349 A 1/1999 Vereschagin et al.
7,115,325 B2 10/2006 Fujimura et al.
(Continued)

FOREIGN PATENT DOCUMENTS

JP 2799337 B2 7/1998
JP 3936724 B1 6/2007
(Continued)

OTHER PUBLICATIONS

International Search Report dated Apr. 4, 2017, in PCT/JP2017/006331
(Continued)

*Primary Examiner* — Vishal V Vasisth
(74) *Attorney, Agent, or Firm* — Birch, Stewart, Kolasch & Birch, LLP

(57) ABSTRACT

A water lubricant composition (10) of the present invention contains water (11) as a lubricating base material and ND particles (12), which are hydrogen-reduced nanodiamond particles. The content of the water (11) in the water lubricant composition (10) is, for example, 90% by mass or more. The content of the ND particles (12) in the water lubricant composition (10) is, for example, 0.1% by mass or less. The water lubricant composition (10) is suitable for achieving low friction in water lubrication. A water lubricating system
(Continued)

of the present invention includes the water lubricant composition (10) which is being used for the lubrication of a SiC member and/or a $SiO_2$ member.

9 Claims, 4 Drawing Sheets

(51) Int. Cl.

| | |
|---|---|
| *C10N 20/06* | (2006.01) |
| *C10N 30/06* | (2006.01) |
| *C10N 50/00* | (2006.01) |

(52) U.S. Cl.
CPC ... *C10M 2201/041* (2013.01); *C10N 2020/06* (2013.01); *C10N 2030/06* (2013.01); *C10N 2050/015* (2020.05)

(56) References Cited

U.S. PATENT DOCUMENTS

| | | | |
|---|---|---|---|
| 7,585,360 | B2 | 9/2009 | Fujimura et al. |
| 7,927,390 | B2 | 4/2011 | Fujimura et al. |
| 8,172,916 | B2 | 5/2012 | Fujimura et al. |
| 2003/0228249 | A1 | 12/2003 | Fujimura et al. |
| 2006/0147644 | A1 | 7/2006 | Fujimura et al. |
| 2010/0069513 | A1 | 3/2010 | Fujimura et al. |
| 2010/0261926 | A1 | 10/2010 | Komatsu et al. |
| 2011/0209642 | A1 | 9/2011 | Fujimura et al. |
| 2017/0240429 | A1 | 8/2017 | Yamakawa |

FOREIGN PATENT DOCUMENTS

| | | | |
|---|---|---|---|
| JP | 2010-126669 | A | 6/2010 |
| JP | 2010-202458 | A | 9/2010 |
| JP | 2010-248023 | A | 11/2010 |
| JP | 2011-84622 | A | 4/2011 |
| TW | I228490 | B | 3/2005 |
| WO | WO 2014/189065 | A1 | 11/2014 |
| WO | WO 2015/097347 | A2 | 7/2015 |
| WO | WO 2016/072138 | A1 | 5/2016 |

OTHER PUBLICATIONS

Written Opinion of the International Searching Authority dated Apr. 4, 2017, in PCT/JP2017/006331.

Extended European Search Report dated Dec. 16, 2019, in European Patent Application No. 17798941.5.

Liu et al., "Tribological properties of nanodiamonds in aqueous suspensions: effect of the surface charge," RSC Adv. (2015), vol. 5, pp. 78933-78940.

[FIG. 1]
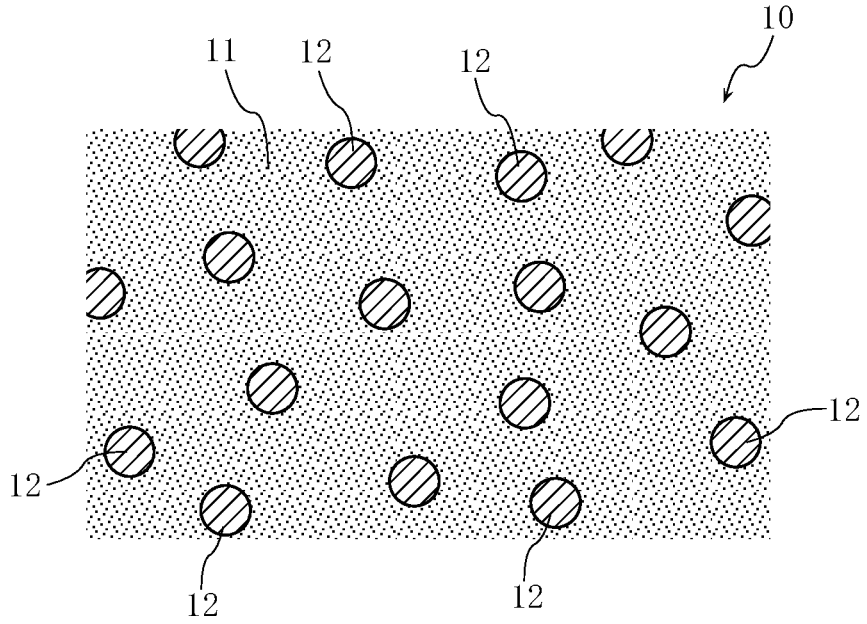

[FIG. 2]
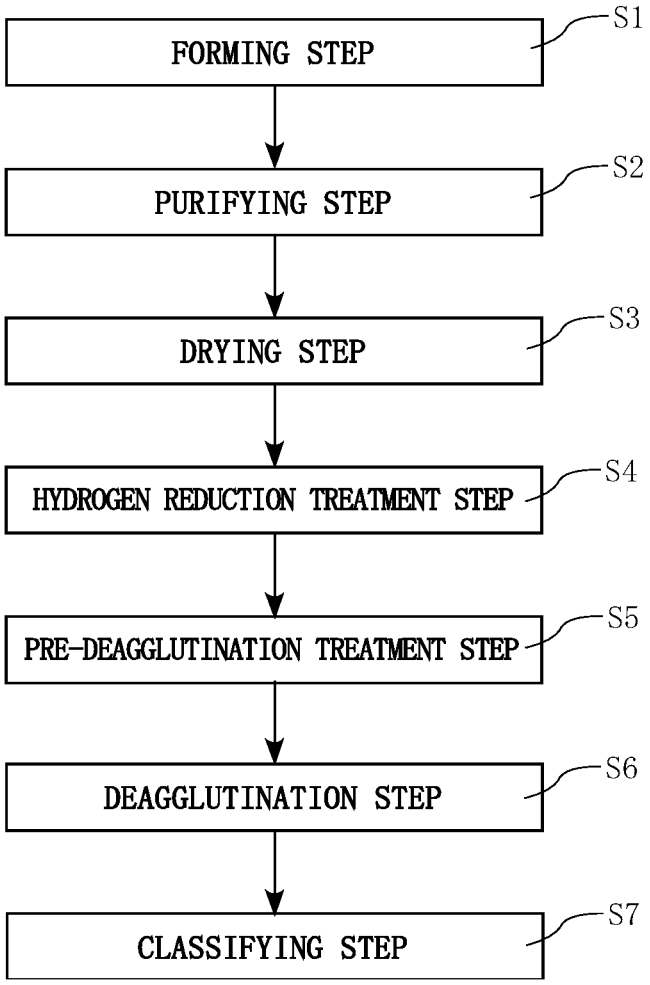
[FIG. 3]
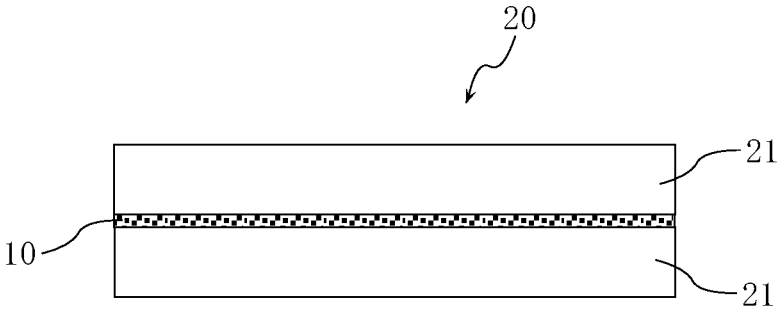

[FIG. 4]
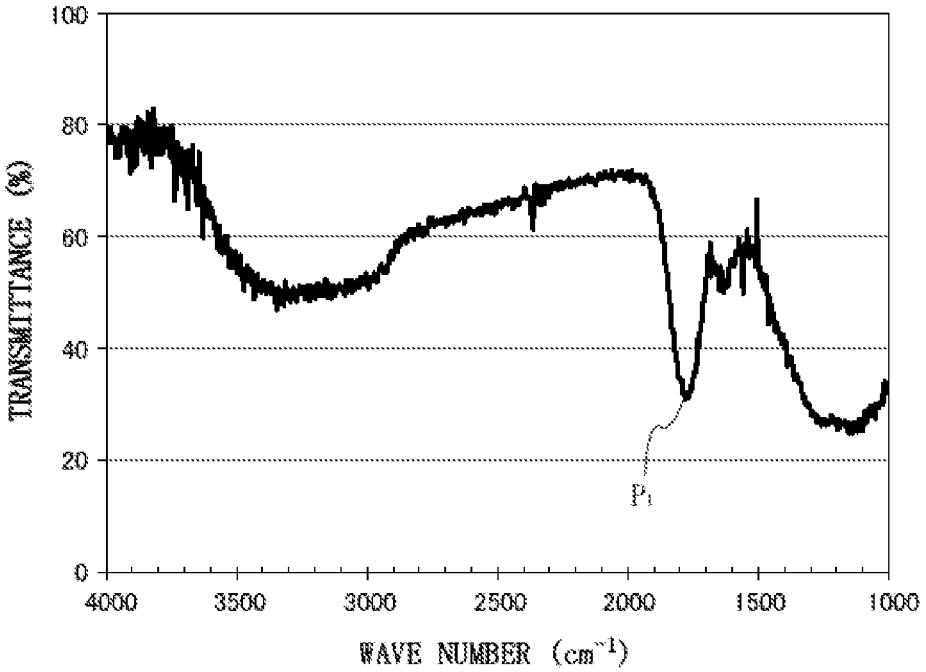
[FIG. 5]
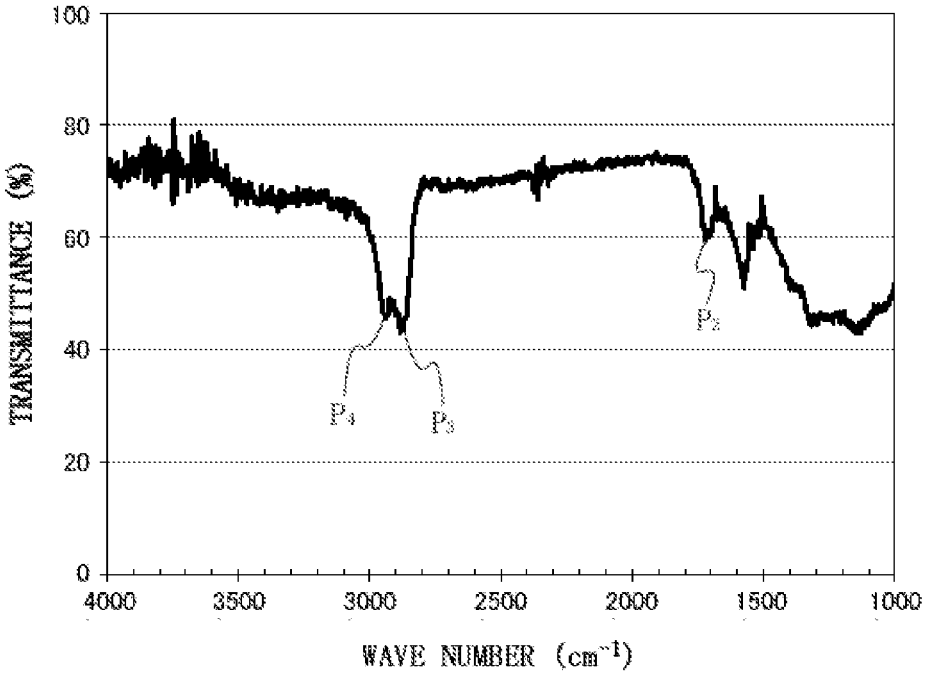

[FIG. 6]
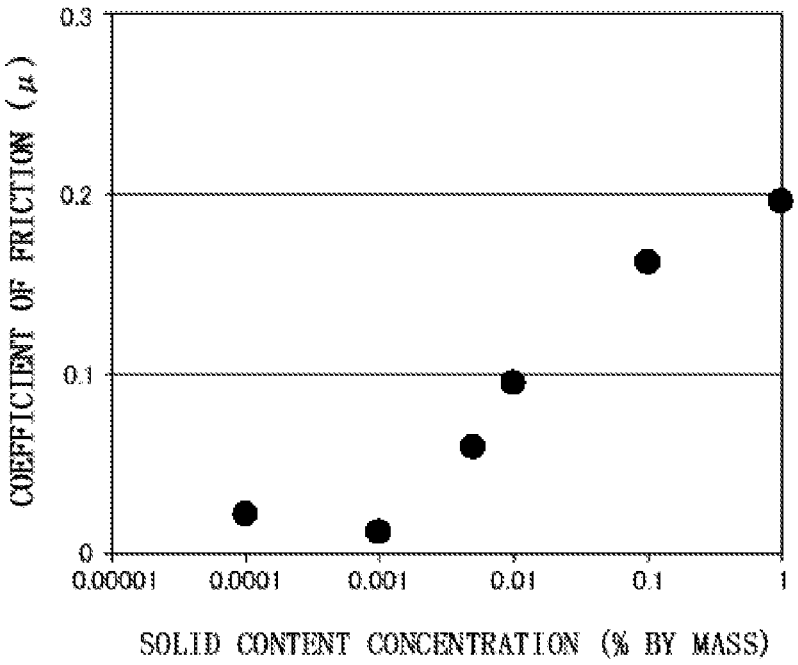

WATER LUBRICANT COMPOSITION AND WATER LUBRICATING SYSTEM

This application is a 371 of PCT/JP2017/006331, filed Feb. 21, 2017.

TECHNICAL FIELD

The present invention relates to a lubricant composition containing water as a lubricating base material, and a lubricating system using the water lubricant composition. This application claims priority to Japanese Patent Application No. 2016-097849, filed on May 16, 2016 in Japan, the entire contents of which application are incorporated herein by reference.

BACKGROUND ART

Water lubrication has recently attracted attention in the field of lubricating technology because of its low environment load, economic advantage, and other advantages. Improvement in water lubricating function is often attempted by blending additives into water as a lubricating base material in water lubricating technology. For example, Non Patent Literature (NPL) 1 and NPL 2 below each describe a water lubricating technology using a water lubricant into which a specified nanodiamond material is blended as an additive.

CITATION LIST

Non Patent Literature

NPL 1: "Water lubrication with hydrophilic nanodiamond", publication name: Function and Materials, CMC Publishing Co., Ltd., the June 2009 issue, Vol. 29, No. 6, p. 30-34

NPL 2: "Lubrication of Ceramics with Single-nanodiamond in an Aqueous Colloid", publication name: Function and Materials, CMC Publishing Co., Ltd., the June 2009 issue, Vol. 29, No. 6, p. 35-42

SUMMARY OF INVENTION

Technical Problem

NPL 1 describes that a water lubricant containing a specified nanodiamond in a content of 1% by mass can achieve low friction with a friction coefficient of 0.02 when used for lubrication between a hydrogel substrate and a sapphire member. NPL 2 describes that a water lubricant containing a specified nanodiamond in a content of 4.9% by mass can achieve low friction with a friction coefficient of 0.09 when used for lubrication between a SiC substrate and an $Al_2O_3$ member. NPL 2 also describes that a water lubricant containing a specified nanodiamond in a content of 0.6% by mass can achieve low friction with a friction coefficient of 0.05 when used for lubrication between a $Si_3N_4$ substrate and an $Al_2O_3$ member.

However, the techniques described in NPL 1 and NPL 2 need relatively large amounts of nanodiamond as additives to water lubricants. The degrees of low friction which can be attained by the techniques described in NPL 1 and NPL 2 may be insufficient depending on the application of water lubrication.

The present invention has been made under these circumstances, and has an object to provide a water lubricant composition that is suitable for achieving low friction in water lubrication and to provide a water lubricating system using such a water lubricant composition.

Solution to Problem

The present invention provides, according to a first aspect, a water lubricant composition. The water lubricant composition contains at least water as a lubricating base material, and hydrogen-reduced nanodiamond particles. As used herein, the term "hydrogen-reduced nanodiamond particle" refers to a particle of nanodiamond that has undergone hydrogen reduction treatment, such as heat-treatment in a hydrogen atmosphere, at any stage prior to being blended into the water lubricant composition. The oxygen content of the hydrogen-reduced nanodiamond particles is preferably 10% by mass or less, and more preferably 9.5% by mass or less. The hydrogen-reduced nanodiamond particles have, for example, a positive zeta potential. The zeta potential of nanodiamond particles is defined as a value measured for nanodiamond particles in an aqueous nanodiamond dispersion at a nanodiamond concentration of 0.2% by mass and 25° C. When an aqueous nanodiamond dispersion as a stock solution needs to be diluted to have a nanodiamond concentration of 0.2% by mass, ultrapure water is used as a diluent.

The water lubricant composition contains the hydrogen-reduced nanodiamond particles as described above, and the present inventors have found that a water lubricant composition containing the hydrogen-reduced nanodiamond particles in addition to water as a lubricating base material can achieve low friction in such an extent that the coefficient of friction is, for example, less than 0.02 in lubrication between predetermined members. Additionally, the present inventors have found that a water lubricant composition containing the hydrogen-reduced nanodiamond particles can achieve low friction with a friction coefficient of, for example, around 0.02 or less in lubrication between predetermined members even though the nanodiamond particle concentration of the composition is relatively low. Furthermore, the present inventors have found that a water lubricant composition containing the hydrogen-reduced nanodiamond particles, when used as a lubricant, tends to exhibit lower friction as its nanodiamond particle concentration decreases in the relatively low nanodiamond particle concentration range. These are as indicated or demonstrated, for example, by after-mentioned examples. This unique low friction occurs probably due to the phenomenon that a surface having both smoothness and wettability is formed on a member such as a slide member, lubricated with the water lubricant composition, by a tribochemical reaction in a system where water and a relatively low concentration of hydrogen-reduced nanodiamond particles are present.

The water lubricant composition according to the first aspect of the present invention is suitable for achieving low friction in water lubrication as described above. The water lubricant composition is suitable for achieving low friction efficiently while suppressing the amount of the hydrogen-reduced nanodiamond particles blended with water as a lubricating base material. The suppression of the blend amount of the hydrogen-reduced nanodiamond particles is preferable from the viewpoint of reducing the production cost of the water lubricant composition.

The content of the hydrogen-reduced nanodiamond particles in the water lubricant composition is preferably 0.1% by mass or less, more preferably 0.01% by mass or less, furthermore preferably 50 ppm by mass or less, particularly preferably 20 ppm by mass or less, especially preferably 15 ppm by mass or less, still more preferably 12 ppm by mass or less, and still furthermore preferably 11 ppm by mass or less. The content of the hydrogen-reduced nanodiamond particles in the water lubricant composition is preferably 0.5 ppm by mass or more, more preferably 0.8 ppm by mass or more, furthermore preferably 1 ppm by mass or more, and particularly preferably 1.5 ppm by mass or more. The content of water in the water lubricant composition is preferably 90% by mass or more, more preferably 95% by mass or more, and furthermore preferably 99% by mass or more. These configurations contribute to achieving low friction efficiently in water lubrication.

The hydrogen-reduced nanodiamond particles are preferably hydrogen reduction-treated products of detonation nanodiamond particles (nanodiamond particles produced by detonation). Detonation can appropriately produce nanodiamonds having a primary particle diameter of 10 nm or less. The hydrogen-reduced nanodiamond particles have a median diameter of preferably 9 nm or less, more preferably 8 nm or less, furthermore preferably 7 nm or less, and particularly preferably 6 nm or less. These configurations are suitable for allowing the hydrogen-reduced nanodiamond particles to have a sufficient surface area per unit mass and to efficiently exhibit a function as a solid lubricant and other functions as an additive.

The present invention provides, according to a second aspect, a water lubricating system. The water lubricating system includes at least the water lubricant composition according to the first aspect of the present invention which is being used for lubrication of a SiC member and/or a $SiO_2$ member. As used herein, the term "SiC member" refers to a member that has a sliding surface to be lubricated and at least a part of its sliding surface is made of SiC. As used herein, the term "$SiO_2$ member" refers to a member that has a sliding surface to be lubricated and at least a part of its sliding surface is made of $SiO_2$. The water lubricating system of such a configuration is suitable for achieving low friction in the water lubrication of the SiC member and/or the $SiO_2$ member, and suitable for achieving low friction efficiently in the water lubrication of the SiC member and/or the $SiO_2$ member while suppressing the amount of the hydrogen-reduced nanodiamond particles blended in the water lubricant composition.

BRIEF DESCRIPTION OF DRAWINGS

FIG. 1 is a schematic enlarged view of a water lubricant composition according to one embodiment of the present invention.

FIG. 2 is a process chart illustrating an exemplary method for producing the water lubricant composition illustrated in FIG. 1.

FIG. 3 is a conceptual schematic view of a water lubricating system according to another embodiment of the present invention.

FIG. 4 shows an FT-IR spectrum obtained by measuring a nanodiamond particles before hydrogen reduction treatment in a process for producing the water lubricant composition of Examples.

FIG. 5 shows an FT-IR spectrum obtained by measuring the nanodiamond particles after hydrogen reduction treatment in the process for producing the water lubricant composition of Examples.

FIG. 6 shows a graph indicating the results of friction tests performed on the water lubricant compositions of Examples.

DESCRIPTION OF EMBODIMENTS

FIG. 1 is a schematic enlarged view of a water lubricant composition 10 according to one embodiment of the present invention. The water lubricant composition 10 contains water 11 as a lubricating base material and ND particles 12, which are hydrogen-reduced nanodiamond particles, and contains other components optionally as needed.

The water 11 in the water lubricant composition 10 is a component that serves as a lubricating base material. The content of the water 11 in the water lubricant composition 10 is preferably 90% by mass or more, more preferably 95% by mass or more, and furthermore preferably 99% by mass or more. This configuration is preferable from an economical viewpoint and from the viewpoint of reduction in an environment load due to the use of a water lubricant composition.

The ND particle 12 in the water lubricant composition 10 is a hydrogen-reduced nanodiamond particle as mentioned above. As used herein, the term "hydrogen-reduced nanodiamond particle" refers to a particle of nanodiamond that has undergone hydrogen reduction treatment, such as heat-treatment in a hydrogen atmosphere, at any stage prior to being blended into the water lubricant composition. The content, or the concentration, of the ND particles 12 in the water lubricant composition 10 is typically 1% by mass or less, preferably 0.1% by mass or less, more preferably 0.01% by mass or less, furthermore preferably 50 ppm by mass or less, particularly preferably 20 ppm by mass or less, especially preferably 15 ppm by mass or less, still more preferably 12 ppm by mass or less, and still furthermore preferably 11 ppm by mass or less in the embodiment. The content, or the concentration, of the ND particles 12 in the water lubricant composition 10 is preferably 0.5 ppm by mass or more, more preferably 0.8 ppm by mass or more, furthermore preferably 1 ppm by mass or more, and particularly preferably 1.5 ppm by mass or more. These configurations contribute to achieving low friction efficiently in water lubrication.

The ND particles 12 contained in the water lubricant composition 10 are each a hydrogen-reduced nanodiamond primary particle or a hydrogen-reduced nanodiamond secondary particle, and are separated from each other and dispersed as colloidal particles in the water lubricant composition 10. As used herein, the term "primary particle of nanodiamond" refers to a nanodiamond having a particle diameter of 10 nm or less. The lower limit of the particle diameter of the nanodiamond primary particle is typically 1 nm. The particle diameter D50 (median diameter) of the ND particles 12 in the water lubricant composition 10 is typically 9 nm or less, preferably 8 nm or less, more preferably 7 nm or less, and furthermore preferably 6 nm or less. These configurations as to the particle diameter of ND particles 12 are suitable for allowing the ND particles 12 to have a sufficient surface area per unit mass and to efficiently exhibit a function as a solid lubricant and other functions as an additive. The particle diameter D50 of the ND particles 12 can be measured, for example, by dynamic light scattering.

The ND particles 12 contained in the water lubricant composition 10 are preferably hydrogen reduction-treated products of detonation nanodiamond particles (nanodiamond particles produced by detonation). Detonation can appropriately produce nanodiamonds having a primary particle diameter of 10 nm or less.

The so-called zeta potential of the ND particles 12 contained in the water lubricant composition 10 is typically positive and is a positive value of, for example, 30 to 50 mV. The zeta potential of the ND particles 12, which are colloidal particles, influences the dispersion stability of the ND particles 12 in the water lubricant composition 10, and the configuration as above is advantageous for stable dispersion and its retention of the ND particles 12 in the water lubricant composition 10. In the embodiment, the zeta potential of nanodiamond particles is defined as a value measured for nanodiamond particles in an aqueous nanodiamond dispersion at a nanodiamond concentration of 0.2% by mass and 25° C. When an aqueous nanodiamond dispersion as a stock solution needs to be diluted to have a nanodiamond concentration of 0.2% by mass, ultrapure water is used as a diluent.

The oxygen content of the ND particles 12 contained in the water lubricant composition 10 is preferably 10% by mass or less, and more preferably 9.5% by mass or less. The oxygen content of the ND particles 12 can be determined from the result of elementary analysis.

The nanodiamond particle itself produced, for example, by the above-mentioned detonation has relatively large number of oxygen-containing functional groups, such as a carboxy group, as surface functional groups. The above-mentioned zeta potential and oxygen content of the nanodiamond particles can be used as indices of the degree of hydrogen reduction by hydrogen reduction treatment for such oxygen-containing surface functional groups. In the embodiment, the state where the zeta potential is positive and the oxygen content is 10% by mass or less for the ND particles 12, which are the hydrogen-reduced nanodiamond particles, can be used as an index of sufficiently performed hydrogen reduction treatment for the present invention.

The water lubricant composition 10 may contain other components in addition to the above-mentioned water 11 and ND particles 12. Non-limiting examples of other components include surfactants; thickeners; coupling agents; antirusts for the rust prevention of metallic members, which are members to be lubricated; corrosion inhibitors for the corrosion suppression of nonmetallic members, which are members to be lubricated; freezing-point depressants; anti-wear additives; antiseptics; colorants; and solid lubricants other than the ND particles 12.

FIG. 2 is a process chart illustrating an exemplary method for producing the above-mentioned water lubricant composition 10. This method includes a forming step S1, a purifying step S2, a drying step S3, a hydrogen reduction treatment step S4, a pre-deagglutination treatment step S5, a deagglutination step S6, and a classifying step S7.

In the forming step S1, detonation is performed to form nanodiamond. Initially, a shaped explosive equipped with an electric detonator is placed in a detonation pressure-tight chamber, and the chamber is hermetically sealed so that the explosive is coexistent with a gas having an atmospheric composition and being at normal atmospheric pressure in the chamber. The chamber is made typically of iron and has a capacity of typically 0.5 to 40 $m^3$, and preferably 2 to 30 $m^3$. A non-limiting example of the explosive usable herein is a mixture of trinitrotoluene (TNT) with cyclotrimethylenetrinitramine, namely, hexogen (RDX). The mixture may have a mass ratio (TNT:RDX) of TNT to RDX in the range of typically from 40:60 to 60:40. The explosive is used in an amount of typically 0.05 to 2.0 kg.

In the forming step S1, next, the electric detonator is ignited to detonate the explosive in the chamber. As used herein, the term "detonation" refers to, among explosions associated with chemical reactions, one in which a flame front travels at a high speed faster than sound, where the reaction occurs at the flame front. In the detonation, the explosive partially undergoes incomplete combustion to liberate carbon, and the liberated carbon serves as a starting material and forms nanodiamond by the action of pressure and energy of a shock wave generated by the explosion. In the formation of such nanodiamond products by the detonation technique, initially, primary particles aggregate to form agglutinates, by very strong interactions between adjacent primary particles or crystallites, namely, by the multiple actions of van der Waals force and Coulomb interaction between crystal faces.

The purifying step S2, according to the embodiment, includes an acid treatment in which the material nanodiamond crude product is acted upon typically by a strong acid in a water medium. The nanodiamond crude product obtained by the detonation technique tends to include metal oxides. The metal oxides are oxides of metals, such as Fe, Co, and Ni, derived typically from the chamber used in the detonation technique. The metal oxides can be dissolved off from, and removed from, the nanodiamond crude product typically by the action of a predetermined strong acid in a water medium (acid treatment). The strong acid for use in the acid treatment is preferably selected from mineral acids, such as hydrochloric acid, hydrofluoric acid, sulfuric acid, nitric acid, and aqua regia. The acid treatment may employ each of different strong acids alone or in combination. The strong acid(s) may be used in the acid treatment in a concentration of typically 1 to 50 mass percent. The acid treatment may be performed at a temperature of typically 70° C. to 150° C. for a time of typically 0.1 to 24 hours. The acid treatment can be performed under reduced pressure, or at normal atmospheric pressure, or under pressure (under a load). After the acid treatment as above, solids (including nanodiamond agglutinates) are washed with water typically by decantation. The water washing of the solids by decantation is preferably repeated until the pH of a sedimentary solution reaches, for example, 2 to 3.

The purifying step S2, according to the embodiment, also includes an oxidation using an oxidizer so as to remove graphite from the nanodiamond crude product (nanodiamond agglutinates before the completion of purification). The nanodiamond crude product obtained by the detonation technique includes graphite. The graphite is derived from carbon that has not formed nanodiamond crystals, out of carbons liberated from the explosive as a result of partial incomplete combustion. The graphite can be removed from the nanodiamond crude product typically by allowing a predetermined oxidizer to act upon the crude product in a water medium (oxidation), typically after the acid treatment. Non-limiting examples of the oxidizer for use in the oxidation include chromic acid, chromic anhydride, dichromic acid, permanganic acid, perchloric acid, and salts of them. The oxidation may employ each of different oxidizers alone or in combination. The oxidizer(s) may be used in the oxidation in a concentration of typically 3 to 50 mass percent. The oxidizer may be used in the oxidation in an amount of typically 300 to 500 parts by mass per 100 parts by mass of the nanodiamond crude product to be subjected to the oxidation. The oxidation may be performed at a temperature of typically 100° C. to 200° C. for a time of typically 1 to 24 hours. The oxidation can be performed under reduced pressure, or at normal atmospheric pressure, or under pressure (under a load). The oxidation is preferably performed in the coexistence of a mineral acid, from the viewpoint of contributing to more efficient graphite removal. Non-limiting examples of the mineral acid include hydrochloric acid, hydrofluoric acid, sulfuric acid, nitric acid, and aqua regia. The mineral acid, when used in the oxidation, may be used in a concentration of typically 5 to 80 mass percent. After the oxidation as above, solids (including nanodiamond agglutinates) are washed with water typically by decantation or centrifugal sedimentation. A supernatant in the early stages of the water washing is colored. The water washing of the solids is preferably repeated until the supernatant becomes visually transparent.

Even after the acid treatment and the solution oxidation as above, the detonation nanodiamonds remain in the form of agglutinates (secondary particles), in which primary particles aggregate with very strong interactions therebetween. To facilitate the separation of the primary particles from the agglutinates, the purifying step S2 may include a treatment in which a predetermined alkali and hydrogen peroxide are allowed to act on the nanodiamonds in a water medium. (alkali and hydrogen peroxide treatment). Even though metal oxides, such as metal oxides which cannot be completely removed by the above-mentioned acid treatment, remain in the nanodiamonds, the alkali and hydrogen peroxide treatment can remove the metal oxides, which facilitates the separation of the nanodiamond primary particles from the nanodiamond agglutinates. Non-limiting examples of the alkali for use in this treatment include sodium hydroxide, ammonia, and potassium hydroxide. In the treatment, the concentration of alkali is typically 0.1 to 5% by mass, and the concentration of hydrogen peroxide is typically 1 to 6% by mass. The treatment may be performed at a temperature of typically 40° C. to 100° C. for a time of typically 0.5 to 5 hours. The treatment can be performed under reduced pressure, or at normal atmospheric pressure, or under pressure (under a load). After the alkali and hydrogen peroxide treatment as above, a supernatant is removed typically by decantation. After the pH of the precipitation liquid obtained by the decantation is adjusted to, for example, 2 to 3, the solid content (containing the nanodiamond agglutinates) in this precipitation liquid is water-washed by centrifugal sedimentation. Specifically, a series of processes including an operation of performing a solid-liquid separation of the precipitation liquid, or suspension, using a centrifuge; an operation of then separating the precipitate from the supernatant fluid; and an operation of then adding ultrapure water to the precipitate and suspending the mixture is repeated until the electrical conductivity of the suspension, when solid content concentration (nanodiamond concentration) is adjusted to 6% by mass, becomes typically 50 to 200 μS/cm.

In the method, the drying step S3 is subsequently performed. Specifically, the supernatant is specifically removed from the nanodiamond-containing solution after the above-mentioned water-washing typically by decantation, and the remaining fraction is then subjected to drying treatment to yield a dry powder. Non-limiting examples of the technique of drying treatment include spray drying performed using a spray-drying device, and evaporation to dryness performed using an evaporator.

In the method, the hydrogen reduction treatment step S4 is subsequently performed. The hydrogen reduction treatment step S4 is a step of hydrogen-reducing the surface of the nanodiamonds, namely a step of reducing oxygen-containing functional groups such as a carboxy group to form hydrogen terminal structure, where the oxygen-containing functional groups may exist on the surface of the nanodiamonds obtained as described above. In this step, the powder of nanodiamond obtained through the drying step S3 is heated in a hydrogen atmosphere using a gas atmosphere furnace. Specifically, the nanodiamond powder is placed in the gas atmosphere furnace, hydrogen-containing gas (containing inert gas besides hydrogen) is fed to the furnace or allowed to flow through the furnace, and the inside of the furnace is heated to a temperature set as a heating temperature, whereby the hydrogen reduction treatment is performed. In the hydrogen reduction treatment, the hydrogen concentration of the hydrogen-containing gas is typically 0.1 to 99.9% by volume. The hydrogen reduction treatment is performed at a heating temperature of typically 300 to 1000° C. for a heating time of typically 1 to 72 hours. The zeta potential measurement and the FT-IR analysis as to the nanodiamond, and the value of the oxygen content, which can be determined by elementary analysis, of the nanodiamond can help determine whether or not the nanodiamond is hydrogen-reduced, and to what extent the nanodiamond is hydrogen-reduced.

In the method, the pre-deagglutination treatment step S5 is subsequently performed. Specifically, the hydrogen-reduced nanodiamond powder obtained through the above-mentioned hydrogen reduction treatment step S4 is dispersed in ultrapure water to prepare a slurry containing the hydrogen-reduced nanodiamond, and the electrical conductivity and the pH of the slurry are then adjusted by water-washing the slurry by centrifugal sedimentation, and/or adding a pH control reagent thereto. In this step, the electrical conductivity of the slurry is adjusted, for example, to 30 to 100 μS/cm per a solid concentration of 1% by mass, and the pH of the slurry is adjusted, for example, to 4 to 9.

In the method, the deagglutination step S6 is subsequently performed. The hydrogen-reduced nanodiamonds obtained through the above-mentioned series of processes takes the form of agglutinates (secondary particles) in which primary particles interact with each other very strongly to aggregate. The deagglutination step S6 is performed to separate a large number of primary particles from the agglutinates. Specifically, the slurry containing hydrogen-reduced nanodiamonds and having the electrical conductivity and the pH adjusted as mentioned above is subjected to a deagglutination treatment. The deagglutination treatment can be performed, for example, using high-shear mixers, homomixers, ball mills, bead mills, high-pressure homogenizers, ultrasonic homogenizers, and colloid mills. The deagglutination treatment may be performed in combination of them. It is preferable to use a bead mill from the viewpoint of efficiency. An aqueous dispersion containing the primary particles of the hydrogen-reduced nanodiamond dispersed as colloidal particles can be obtained through the deagglutination step S6.

In the method, the classifying step S7 is subsequently performed. For example, coarse particles can be removed from the hydrogen-reduced aqueous nanodiamond dispersion by a classifying operation using centrifugal separation with a classifier. After this step, for the hydrogen-reduced aqueous nanodiamond dispersion, the concentration and the pH are adjusted, and the above-mentioned other components are added, if needed.

The above-mentioned water lubricant composition 10 containing at least the water 11 as a lubricating base material and the ND particles 12, which are hydrogen-reduced nanodiamond particles, can be produced as above.

The water lubricant composition 10 contains the ND particles 12, which are hydrogen-reduced nanodiamond particles as described above, and the present inventors have found that the water lubricant composition 10 containing the ND particles 12 in addition to the water 11 as a lubricating base material can achieve low friction in such an extent that the coefficient of friction is, for example, less than 0.02 in lubrication between predetermined members. Additionally, the present inventors have found that the water lubricant composition 10 containing the ND particles 12, which are the hydrogen-reduced nanodiamond particles, can achieve low friction with a friction coefficient of, for example, around 0.02 or less in lubrication between predetermined members even though the nanodiamond particle concentration of the composition is relatively low. Furthermore, the present inventors have found that the water lubricant composition 10 containing the ND particles 12, which are the hydrogen-reduced nanodiamond particles, tends to exhibit lower friction as its nanodiamond particle concentration decreases in the relatively low nanodiamond particle concentration range when used as a lubricant. These are as indicated or demonstrated, for example, by after-mentioned examples. This unique low friction occurs probably due to the phenomenon that a surface having both smoothness and wettability is formed on a member such as a slide member, lubricated with the water lubricant composition 10, by a tribochemical reaction in a system where the water 11 and a relatively low concentration of ND particles are present.

The water lubricant composition 10 as above is suitable for achieving low friction in water lubrication. The water lubricant composition 10 is suitable for achieving low friction efficiently while suppressing the amount of the ND particles 12 blended with the water 11 as a lubricating base material. The suppression of the blend amount of the ND particles 12 is preferable from the viewpoint of reducing the production cost of the water lubricant composition 10.

The water 11 content in the water lubricant composition 10 is preferably 90% by mass or more, more preferably 95% by mass or more, and furthermore preferably 99% by mass or more. The content of the ND particles 12 in the water lubricant composition 10 is preferably 0.1% by mass or less, more preferably 0.01% by mass or less, furthermore preferably 50 ppm by mass or less, particularly preferably 20 ppm by mass or less, especially preferably 15 ppm by mass or less, still more preferably 12 ppm by mass or less, and still furthermore preferably 11 ppm by mass or less; and preferably 0.5 ppm by mass or more, more preferably 0.8 ppm by mass or more, furthermore preferably 1 ppm by mass or more, and particularly preferably 1.5 ppm by mass or more. These configurations contribute to achieving low friction efficiently in water lubrication by the water lubricant composition 10.

FIG. 3 is a conceptual schematic view of a water lubricating system 20 according to another embodiment of the present invention. The water lubricating system 20 has a configuration including a plurality of members 21 and the water lubricant composition 10. The members 21 have surfaces (sliding surfaces) which relatively move and interact with each other. The members 21 includes, for example, a SiC member and/or a $SiO_2$ member. As used herein, the term "SiC member" refers to a member that has a sliding surface to be lubricated and at least a part of its sliding surface is made of SiC. As used herein, the term "$SiO_2$ member" refers to a member that has a sliding surface to be lubricated and at least a part of its sliding surface is made of $SiO_2$. The water lubricant composition 10 contains at least the water 11 and the ND particles 12 as mentioned above, and is used for lubrication on the sliding surfaces of the members 21. The water lubricating system 20 of such a configuration is suitable for achieving low friction between the members 21 using the water lubricant composition 10. Such a water lubricating system 20 is useful, for example, for the lubrication between parts for medical apparatuses and semiconductor manufacturing apparatuses.

EXAMPLES

A stock solution of a water lubricant composition was produced through a purifying step, a drying step, a hydrogen reduction treatment step, a pre-deagglutination treatment step, a deagglutination step and a classifying step as described below.

In the purifying step, a nanodiamond crude product was first subjected to acid treatment. Specifically, 200 g of air-cooled detonation nanodiamond soot, which was a nanodiamond crude product (the particle diameter of nanodiamond primary particles is 4 to 6 nm, produced by Daicel Corporation) and 2 L of 10% by mass hydrochloric acid were mixed to give a slurry, and the slurry was subjected to a heating treatment under reflux at normal atmospheric pressure for one hour. The acid treatment was performed at a heating temperature of 85° C. to 100° C. Next, after cooling, solids (including nanodiamond agglutinates and soot) were washed with water by decantation. The water washing of solids by decantation was repeatedly performed until the pH of the sedimentary solution became from a low pH to 2.

Next, oxidation in the purifying step was performed. Specifically, initially, the sedimentary solution after the decantation was combined with 2 L of 60 mass percent aqueous sulfuric acid solution and 2 L of 50 mass percent aqueous chromic acid solution to give a slurry, and the slurry was subjected to a heat treatment under reflux at normal atmospheric pressure for 5 hours. This oxidation was performed at a heating temperature of 120° C. to 140° C. Next, after cooling, solids (including nanodiamond agglutinates) in the slurry were washed with water by decantation. A supernatant at the beginning of the water washing was colored; and the water washing of solids by decantation was repeatedly performed until the supernatant became visually transparent. The nanodiamond agglutinates contained in the precipitation liquid after the water washing have a particle diameter D50 (median diameter) of 2 μm.

Next, alkali and hydrogen peroxide treatment of the purifying step was performed. Specifically, the sedimentary fluid after decantation was combined with 1 L of a 10 mass percent aqueous sodium hydroxide solution and 1 L of a 30 mass percent aqueous hydrogen peroxide solution to give a slurry, and the slurry was subjected to a heat treatment under reflux at normal atmospheric pressure for one hour. The heating in the treatment was performed at a temperature of 50 to 105° C. As to the slurry subjected to the alkali and hydrogen peroxide treatment, a precipitation liquid was then obtained by removing a supernatant after cooling by decantation. Hydrochloric acid was added to the precipitation liquid, and the pH of the precipitation was adjusted to 2.5. Solids (containing nanodiamond agglutinates) in the precipitation liquid was then water-washed by centrifugal sedimentation. Specifically, a series of processes including an operation of performing a solid-liquid separation of the precipitation liquid, or the suspension, using the centrifuge; an operation of then separating the precipitate from the supernatant fluid; and an operation of then adding ultrapure water to the precipitate followed by suspension was repeated until the electrical conductivity of the suspension, when the solid content concentration (nanodiamond concentration) was adjusted to 6% by mass, reached 56 μS/cm. The pH of the solution after such water washing was 4.3.

Next, the drying step was performed. Specifically, 1000 mL of the nanodiamond-containing liquid obtained through the above-mentioned alkali and hydrogen peroxide treatment was spray-dried using a spray-drying device (trade name "spray drier B-290", manufactured by BUCHI Corporation), whereby 50 g of a nanodiamond powder was obtained.

Elementary analysis was performed on the nanodiamond that had been subjected to up to such a drying step, using an elementary analysis device (trade name "JM10", J-SCIENCE Corporation), and the proportions on the basis of the total amount of carbon element, hydrogen element, nitrogen element and oxygen element were 80.5% by mass for carbon element, 1.4% by mass for hydrogen element, 2.3% by mass for nitrogen element, and 15.8% by mass for oxygen element. The zeta potential was measured as described below for the nanodiamond that had been subjected to up to the drying step, and the measured value was −47 mV (pH 7). FT-IR measurement was performed as described below on the nanodiamond that had been subjected to up to the drying step, and the FT-IR spectrum shown in FIG. 4 was obtained. In the FT-IR spectrum of FIG. 4, the axis of abscissas shows the wave number ($cm^{-1}$) as to the measurement, and the axis of ordinates shows the transmittance (%) as to the measurement.

Next, the hydrogen reduction treatment step was performed using a gas atmosphere furnace (trade name "gas atmosphere tube furnace KTF045N1", Koyo Thermo Systems Co., Ltd.). Specifically, 50 g of the nanodiamond powder obtained as mentioned above was left to stand in the tubular furnace of the gas atmosphere furnace, the pressure in the tubular furnace was reduced, and after 10 minutes, air was then purged from the tubular furnace with argon gas. The process from the above-mentioned pressure reduction to the above-mentioned argon purge was repeated 3 times in total, and argon gas was continuously made to flow through the tubular furnace. Thus, air was replaced with argon in the furnace. Then, the flowing gas was switched from argon to hydrogen (purity 99.99% by volume or more) with the flow rate of the hydrogen gas being set as 4 L/min, and the hydrogen gas was kept to flow through the tubular furnace for 30 minutes. The temperature in the furnace was raised to 600° C. for 2 hours long and maintained at 600° C. for 5 hours. The heating was stopped, followed by natural cooling. After the furnace temperature reached room temperature, the flowing gas was switched from hydrogen to argon, and argon gas was kept to flow through the tubular furnace for 10 hours. The flow of argon gas was then stopped, the furnace was left to stand for 30 minutes, and a nanodiamond powder was collected from the furnace. The collected nanodiamond powder was 44 g.

Elementary analysis was performed on the nanodiamond that had been subjected to up to such hydrogen reduction treatment step, using the elementary analysis device (trade name "JM10", manufactured by J-SCIENCE Corporation), and the proportions on the basis of the total amount of carbon element, hydrogen element, nitrogen element and oxygen element were 86.7% by mass for carbon element, 1.5% by mass for hydrogen element, 2.3% by mass for nitrogen element, and 9.5% by mass for oxygen element. FT-IR measurement was performed as described below on the nanodiamond that had been subjected to up to the hydrogen reduction treatment step, and the FT-IR spectrum shown in FIG. 5 was obtained. In the FT-IR spectrum of FIG. 5, the axis of abscissas shows the wave number ($cm^{-1}$) as to the measurement, and the axis of ordinates shows the transmittance (%) as to the measurement.

Next, the pre-deagglutination treatment step was performed. Specifically, ultrapure water was first added to 5.6 g of the hydrogen-reduced nanodiamond powder that had been obtained through the hydrogen reduction treatment step to give 280 g of a suspension, and the suspension was stirred with a stirrer at room temperature for one hour to give a slurry. Next, the slurry was washed by centrifugal sedimentation. Specifically, the slurry was subjected to solid-liquid separation by centrifugal separation at a force of 20000× g for 10 minutes, and a resulting supernatant was removed. Next, ultrapure water was added to the precipitate after the removal of the supernatant to give 280 g of a suspension, and the suspension was stirred with a stirrer at room temperature for one hour to give a slurry. Next, the slurry was subjected to ultrasonic cleaning treatment for 2 hours using an ultrasonic irradiation machine (trade name "ultrasonic cleaner AS-3", manufactured by AS ONE Corporation). The slurry thus obtained had an electrical conductivity of 35 μS/cm and a pH of 9.41.

Next, 280 g of the slurry obtained in the above-mentioned pre-deagglutination treatment step was subjected to the deagglutination step by bead milling with a bead milling device (trade name "bead mill RMB" AIMEX CO., Ltd.). In this step, zirconia beads of 30 μm in diameter was used as a deagglutination medium, the amount of the zirconia beads fed to 280 g of the slurry in the mill container was 280 ml, the peripheral speed of the rotary blades rotated in the mill container was 8 m/second, and the milling was performed for 2 hours.

Next, the classifying step was performed. Specifically, coarse particles were removed from the slurry, which had been subjected to the above-mentioned deagglutination step, by classification operation using centrifugal separation (20000× g, 10 minutes). A stock solution of the water lubricant composition in which the hydrogen-reduced nanodiamond particles were dispersed in the water as a lubricating base material was prepared as mentioned above. As to the hydrogen-reduced nanodiamond particles in the water lubricant composition, the concentration (solid content concentration of the water lubricant composition) was 1.4% by mass, the particle diameter D50 (median diameter) was 6.0 nm, the electrical conductivity was 70 μS/cm, the pH was 7.8, and the zeta potential was +48 mV.

Examples 1 to 6

The water lubricant composition stock solution prepared as mentioned above is diluted with ultrapure water to prepare a water lubricant composition of Example (at a solid content concentration of 1% by mass), a water lubricant composition of Example 2 (at a solid content concentration of 0.1% by mass), a water lubricant composition of Example 3 (at a solid content concentration of 0.01% by mass), a water lubricant composition of Example 4 (at a solid content concentration of 0.005% by mass, namely 50 ppm by mass), a water lubricant composition of Example 5 (at a solid content concentration of 0.001% by mass, namely 10 ppm by mass), and a water lubricant composition of Example 6 (at a solid content concentration of 0.0001% by mass, namely 1 ppm by mass).

Friction Test

On each of the water lubricant compositions of Examples 1 to 6, a friction test was performed to determine a friction coefficient between a disk substrate made of silicon carbide (30 mm in diameter and 4 mm in thickness) and a ball made of silicon carbide (8 mm in diameter) with the water lubricant composition therebetween for lubrication. The friction test was performed using a ball-on-disk sliding friction tester. Specifically, 400 μl of the water lubricant composition was dropped on the disk substrate surface at the start of the test, and the disk substrate was rotated with the ball in contact with the disk substrate surface, whereby the ball relatively slid on the disk substrate surface. In this friction test, the test temperature was room temperature, the load of the ball on the disk substrate surface was 10 N, the sliding velocity of the ball on the disk substrate surface was 100 mm/second, the total relative sliding distance of the ball on the disk substrate surface was 100 m, and the average value of friction coefficients at sliding distances of 90 to 100 m was obtained as a friction coefficient (p) for each water lubricant composition. The friction coefficients of the water lubricant compositions of Examples 1 to 6 were 0.19 (Example 1), 0.16 (Example 2), 0.094 (Example 3), 0.059 (Example 4), 0.011 (Example 5) and 0.021 (Example 6). These results are shown together in the graph of FIG. 6. In the graph of FIG. 6, the axis of abscissas shows the solid content concentration (% by mass) of a water lubricant composition on a natural logarithmic scale, and the axis of ordinates shows the coefficient of friction (p) as to the measurement. When the friction test was performed in the same method and under the same conditions except for using pure water instead of the composition of Examples 1 to 6, the determined friction coefficient (p) was 0.21.

Nanodiamond Concentration

The nanodiamond concentration of an analyte nanodiamond dispersion was calculated from: a weight determined by weighing 3 to 5 g of the dispersion; and a weight determined by heating and thereby evaporating the weighed dispersion to remove water therefrom and to leave dry matter (powder), and weighing the dry matter using a precision balance.

Median Diameter

The particle diameter D50 (median diameter) of nanodiamond particles contained in an analyte nanodiamond dispersion was a value measured by a dynamic light scattering technique (noncontact backscatter mode) using a device manufactured by Spectris Co., Ltd. (trade name "Zetasizer Nano ZS"). Before the measurement, a sample nanodiamond dispersion was diluted with ultrapure water to a nanodiamond concentration of 0.5 to 2.0 mass percent, and then sonicated using an ultrasonic cleaner, to give the analyte.

Zeta Potential

The zeta potential of nanodiamond particles contained in an analyte nanodiamond dispersion was a value measured by laser Doppler electrophoresis using an apparatus Zetasizer Nano ZS (trade name) supplied by Spectris Co., Ltd. Before the measurement, a sample nanodiamond dispersion was diluted with ultrapure water to a nanodiamond concentration of 0.2 mass percent, and exposed to ultrasound using an ultrasonic cleaner, to give the analyte. The zeta potential measurement temperature was 25° C. The pH of the nanodiamond dispersion subjected to the measurement was a value measured using a pH test paper (trade name Three Band pH Test Paper, supplied by AS ONE Corporation).

FT-IR Analysis

Fourier transform infrared spectroscopic analysis (FT-IR) was performed using an FT-IR device (trade name "Spectrum 400 FT-IR", manufactured by PerkinElmer Japan Co., Ltd.) on each of the above-mentioned nanodiamond samples before and after the hydrogen reduction treatment step. In this measurement, an infrared absorption spectrum was measured on a sample, which was an object to be measured, while heating the sample at 150° C. in a vacuum atmosphere. The heating in a vacuum atmosphere was achieved using Heat Chamber Model-HC900 manufactured by ST Japan INC. and Thermo Controller Model TC-100WA together.

Evaluation

According to the results of the above-mentioned elementary analysis, the proportion of the oxygen element in the nanodiamond particles was 15.8% by mass before the hydrogen reduction treatment step, and became 9.5% by mass, which is less than 10% by mass, after the hydrogen reduction treatment step. The zeta potential of the nanodiamond particles was −47 mV, which was negative, before the hydrogen reduction treatment step, and became +48 mV, which was positive, after the hydrogen reduction treatment step. In addition, the comparison of FT-IR spectra shown in FIGS. 4 and 5 reveals that absorption $P_1$ near 1780 $cm^{-1}$ (FIG. 4) assigned to C═O stretching vibration disappeared by subjecting the nanodiamond particles to the hydrogen reduction treatment. Due to such disappearance of the absorption $P_1$, absorption $P_2$ near 1730 $cm^{-1}$ assigned to C═C stretching vibration can be confirmed clearly in the FT-IR spectrum of FIG. 5. Moreover, the comparison of the FT-IR spectra reveals that absorption $P_3$ (FIG. 5) near 2870 $cm^{-1}$ and absorption $P_4$ (FIG. 5) near 2940 $cm^{-1}$, both assigned to CH stretching vibration of methylene groups, appeared as characteristic absorption since the nanodiamond particles unergone hydrogen reduction treatment. These reveal that the hydrogen reduction sufficiently proceeded on the nanodiamond surface in the above-mentioned hydrogen reduction treatment step, namely that, in the hydrogen reduction treatment step, the formation of hydrogen terminal structure sufficiently proceeded by reducing oxygen-containing functional groups, such as carboxy groups, which could exist on the nanodiamond surface. The water lubricant compositions of Examples 1 to 6 containing such hydrogen-reduced nanodiamond particles exhibited the friction coefficients (p) shown together in the graph of FIG. 6 in the above-mentioned friction test. Specifically, the water lubricant composition of Example 5, whose hydrogen-reduced nanodiamond concentration was a super low concentration of 0.001% by mass, namely 10 ppm by mass, achieved super low friction at a friction coefficient of 0.011 as mentioned above. The water lubricant composition of Example 6, whose hydrogen-reduced nanodiamond concentration was a super low concentration of 0.0001% by mass, namely 1 ppm by mass, achieved super low friction at a friction coefficient of 0.021 as mentioned above. The water lubricant compositions of Examples 1 to 5 showed a tendency to strengthen the occurrence of low friction as the nanodiamond particle concentration decreases in the range of relatively low concentrations of 0.001% by mass to 1% by mass.

As a summary of the above description, configurations and variations thereof according to the present invention are listed as appendices below.

Appendix 1: A water lubricant composition containing:
water as a lubricating base material; and
a hydrogen-reduced nanodiamond particles.

Appendix 2: The water lubricant composition according to appendix 1, wherein the hydrogen-reduced nanodiamond particles are present in a content of 0.1% by mass or less.

Appendix 3: The water lubricant composition according to appendix 1, wherein the hydrogen-reduced nanodiamond particles are present in a content of 0.01% by mass or less.

Appendix 4: The water lubricant composition according to appendix 1, wherein the hydrogen-reduced nanodiamond particles are present in a content of 50 ppm by mass or less.

Appendix 5: The water lubricant composition according to appendix 1, wherein the hydrogen-reduced nanodiamond particles are present in a content of 20 ppm by mass or less.

Appendix 6: The water lubricant composition according to appendix 1, wherein the hydrogen-reduced nanodiamond particles are present in a content of 15 ppm by mass or less.

Appendix 7: The water lubricant composition according to appendix 1, wherein the hydrogen-reduced nanodiamond particles are present in a content of 12 ppm by mass or less.

Appendix 8: The water lubricant composition according to appendix 1, wherein the hydrogen-reduced nanodiamond particles are present in a content of 11 ppm by mass or less.

Appendix 9: The water lubricant composition according to any one of appendices 1 to 8, wherein the hydrogen-reduced nanodiamond particles are present in a content of 0.5 ppm by mass or more.

Appendix 10: The water lubricant composition according to any one of appendices 1 to 8, wherein the hydrogen-reduced nanodiamond particles are present in a content of 0.8 ppm by mass or more.

Appendix 11: The water lubricant composition according to any one of appendices 1 to 8, wherein the hydrogen-reduced nanodiamond particles are present in a content of 1 ppm by mass or more.

Appendix 12: The water lubricant composition according to any one of appendices 1 to 8, wherein the hydrogen-reduced nanodiamond particles are present in a content of 1.5 ppm by mass or more.

Appendix 13: The water lubricant composition according to any one of appendices 1 to 12, wherein the water is present in a content of 90% by mass or more.

Appendix 14: The water lubricant composition according to any one of appendices 1 to 12, wherein the water is present in a content of 95% by mass or more.

Appendix 15: The water lubricant composition according to any one of appendices 1 to 12, wherein the water is present in a content of 99% by mass or more.

Appendix 16: The water lubricant composition according to any one of appendices 1 to 15, wherein the hydrogen-reduced nanodiamond particles are hydrogen reduction-treated products of detonation nanodiamond particles.

Appendix 17: The water lubricant composition according to any one of appendices 1 to 16, wherein the hydrogen-reduced nanodiamond particles have a median diameter of 9 nm or less.

Appendix 18: The water lubricant composition according to any one of appendices 1 to 16, wherein the hydrogen-reduced nanodiamond particles have a median diameter of 8 nm or less.

Appendix 19: The water lubricant composition according to any one of appendices 1 to 16, wherein the hydrogen-reduced nanodiamond particles have a median diameter of 7 nm or less.

Appendix 20: The water lubricant composition according to any one of appendices 1 to 16, wherein the hydrogen-reduced nanodiamond particles have a median diameter of 6 nm or less.

Appendix 21: The water lubricant composition according to any one of appendices 1 to 20, wherein the hydrogen-reduced nanodiamond particles have a positive zeta potential.

Appendix 22: The water lubricant composition according to any one of appendices 1 to 21, wherein an oxygen content of the hydrogen-reduced nanodiamond particles is 10% by mass or less.

Appendix 23: The water lubricant composition according to any one of appendices 1 to 21, wherein an oxygen content of the hydrogen-reduced nanodiamond particles is 9.5% by mass or less.

Appendix 24: A water lubricating system comprising the water lubricant composition according to any one of appendices 1 to 23 being used for lubrication of a SiC member and/or a $SiO_2$ member.

REFERENCE SIGNS LIST

10 water lubricant composition
11 water
12 ND particle (hydrogen-reduced nanodiamond particle)
20 water lubricating system
21 member
S1 forming step
S2 purifying step
S3 drying step
S4 hydrogen reduction treatment step
S5 pre-deagglutination treatment step
S6 deagglutination step
S7 classifying step

The invention claimed is:

1. A water lubricant composition comprising:
water as a lubricating base material; and
hydrogen-reduced nanodiamond particles,
wherein the hydrogen-reduced nanodiamond particles are present in a content of 0.1% by mass or less,
wherein the hydrogen-reduced nanodiamond particles are present in a content of 0.5 ppm by mass or more,
wherein the hydrogen-reduced nanodiamond particles have a positive zeta potential, and
wherein the zeta potential is measured by Doppler electrophoresis at a measurement temperature of 25° C.

2. The water lubricant composition according to claim 1, wherein the hydrogen-reduced nanodiamond particles are present in a content of 0.01% by mass or less.

3. The water lubricant composition according to claim 1, wherein the hydrogen-reduced nanodiamond particles are present in a content of 50 ppm by mass or less.

4. The water lubricant composition according to claim 1, wherein the hydrogen-reduced nanodiamond particles are present in a content of 20 ppm by mass or less.

5. The water lubricant composition according to claim 1, wherein the water is present in a content of 90% by mass or more.

6. The water lubricant composition according to claim 1, wherein the hydrogen-reduced nanodiamond particles are hydrogen reduction-treated products of detonation nanodiamond particles.

7. The water lubricant composition according to claim 1, wherein the hydrogen-reduced nanodiamond particles have a median diameter of 9 nm or less, and
wherein the median diameter is measured by dynamic light scattering technique using a noncontact backscatter mode.

8. The water lubricant composition according to claim 1, wherein an oxygen content of the hydrogen-reduced nanodiamond particles is 10% by mass or less.

9. A water lubricating system comprising:
the water lubricant composition according to claim 1 being used for lubrication of a SiC member and/or a $SiO_2$ member.

* * * * *